US006540856B2

(12) United States Patent
O'Mara et al.

(10) Patent No.: US 6,540,856 B2
(45) Date of Patent: Apr. 1, 2003

(54) HAND HELD TAPE AND COMPOUND DISPENSER

(75) Inventors: John E. O'Mara, Wichita, KS (US); Robert E. O'Mara, Wichita, KS (US); Daniel Dea Dillinger, Parsons, KS (US)

(73) Assignee: Renegade Tool, LLC, Parsons, KS (US)

( * ) Notice: Subject to any disclaimer, the term of this patent is extended or adjusted under 35 U.S.C. 154(b) by 0 days.

(21) Appl. No.: 09/929,228

(22) Filed: Aug. 13, 2001

(65) Prior Publication Data

US 2002/0020482 A1 Feb. 21, 2002

Related U.S. Application Data

(63) Continuation-in-part of application No. 09/498,101, filed on Feb. 4, 2000, now Pat. No. 6,294,034.

(51) Int. Cl.[7] ..... B44C 7/04

(52) U.S. Cl. ..... 156/71; 156/575; 156/577; 156/578; 156/579

(58) Field of Search ..... 156/71, 250, 523, 156/524, 526, 574, 575, 577, 578, 579

(56) References Cited

U.S. PATENT DOCUMENTS

| | | | | |
|---|---|---|---|---|
| 2,741,220 A | | 4/1956 | Belisle | 118/405 |
| 2,815,142 A | | 12/1957 | Ames | 216/25 |
| 3,260,638 A | | 7/1966 | Hoveland | 156/575 |
| 3,576,091 A | | 4/1971 | Shull, Jr. | 52/309 |
| 3,880,701 A | | 4/1975 | Moree | 156/526 |
| 4,105,490 A | | 8/1978 | Lass | 156/526 |
| 4,208,239 A | | 6/1980 | Lass | 156/575 |
| 4,309,238 A | | 1/1982 | Hauk | 156/575 |
| 4,469,342 A | | 9/1984 | Millard | 280/148 |
| 4,587,886 A | | 5/1986 | Masuda | 91/415 |
| 4,642,158 A | | 2/1987 | Stinel | 156/497 |
| 4,652,331 A | | 3/1987 | Plasencia | 156/526 |
| 4,689,107 A | | 8/1987 | Entwistle | 156/465 |
| 4,707,202 A | | 11/1987 | Sweeny | 156/71 |
| 4,775,442 A | | 10/1988 | Januska | 156/575 |
| 4,828,647 A | | 5/1989 | Eccleston | 156/526 |
| 5,013,389 A | | 5/1991 | Retti | 156/526 |
| 5,114,527 A | * | 5/1992 | Stern et al. | 156/575 |
| 5,242,495 A | | 9/1993 | Hammond | 118/43 |
| 5,814,184 A | * | 9/1998 | Denkins | 156/577 |
| 6,294,034 B1 | * | 9/2001 | O'Mara et al. | 156/71 |

* cited by examiner

*Primary Examiner*—James Sells
(74) *Attorney, Agent, or Firm*—Bracewell & Patterson, L.L.P.

(57) ABSTRACT

A tape and wallboard compound dispenser is a handheld unit that has a separate compound channel and tape channel, both of which terminate slightly rearward of a blade located on the forward end of the unit. The unit has a housing with a compartment for containing a roll of tape. A flexible strap is mounted to the side of the housing to provide a loop for insertion of a hand of a user to carry the dispenser. In a manual mode, a single lever controls flow of compound from a pump to the compound channel as well as severing the tape at the end of the stroke. The lever has an off position that shuts off flow of compound to the compound channel. It has an on position that allows flow of compound to the compound channel. It has a cutting position that actuates a cutting mechanism to cut the tape and simultaneously to shut off flow of compound to the compound channel.

21 Claims, 5 Drawing Sheets

HAND HELD TAPE AND COMPOUND DISPENSER

CROSS-REFERENCE TO RELATED APPLICATION

This invention is a continuation-in-part of application Ser. No. 09/498,101, filed Feb. 4, 2000 U.S. Pat. No. 6,294,034.

BACKGROUND OF THE INVENTION

1. Technical Field

This invention relates in general to preparing dry wall surfaces, and in particular to an improved compound and tape dispenser.

2. Description of the Prior Art

Efficiently providing drywall tape with a coating of drywall compound of desired thickness for application to drywall panels is one of the problems associated with "taping and floating" drywall joints, seams, and cracks in walls and ceilings. Conventional designs for achieving this end typically utilize a tray or container of compound, also called "mud", which is carried by or positioned near the user. A roll of drywall tape is also carried by the user. The tape is manually dispensed and extended through the drywall mud in the container for application of the drywall mud to the tape prior to application of the tape to the drywall panels. This system is cumbersome and difficult to master, since it requires considerable manual dexterity to remove a strip of tape of desired length from the roll and extend the tape through the drywall mud container to uniformly apply drywall mud to the tape in a desired thickness for application to the drywall panels.

Prior art drywall application systems have a number of significant problems. One difficulty with these techniques is trying to uniformly apply the drywall mud to the tape such that the tape will be securely applied to the drywall crack, space, or seam to provide a smooth and efficient floating job. Another inefficiency associated with conventional equipment is the frequent requirement of refilling the relatively small mud container, which requires additional time and is labor-intensive, thus adding to the cost of the job. Yet another problem is the extreme caution the user must take in order to avoid spilling the slurry or mud when the user is bending, squatting or stooping to perform various necessary functions on the job. Finally, prior art drywall mud containers must be cleaned before breaks, lunch or at the end of the day, to avoid contamination of the mud with dried mud particles. Thus, an improved method and apparatus for applying drywall tape and texture is needed.

SUMMARY OF THE INVENTION

The tape and compound dispenser of this invention has a frame with a blade mounted to the forward or distal end. The frame has a tape channel with a rectangular outlet below and rearward of the blade for receiving a web of the tape to be applied to a wall surface. A compound channel, which is separate from the tape channel, has an inlet for receiving compound from a hose connected to a pump. The compound channel has a rectangular outlet below the outlet of the tape channel and rearward of the blade for dispensing compound onto the wall surface as the tape is being applied. The blade serves to wipe excess compound from the wall surface.

A tape roll housing is mounted to the frame, the tape roll housing having a storage compartment for holding a roll of tape. A flexible strap extends across one side of the tape roll housing. The tape roll housing preferably has a grip for gripping by user. The strap fits over the wrist of the user. A manually actuable trigger operates to control an electrical switch that allows flow of compound from the pump. The trigger also controls a cutting mechanism to cut the tape at the conclusion of a stroke.

DESCRIPTION OF THE INVENTION

Figure 2:
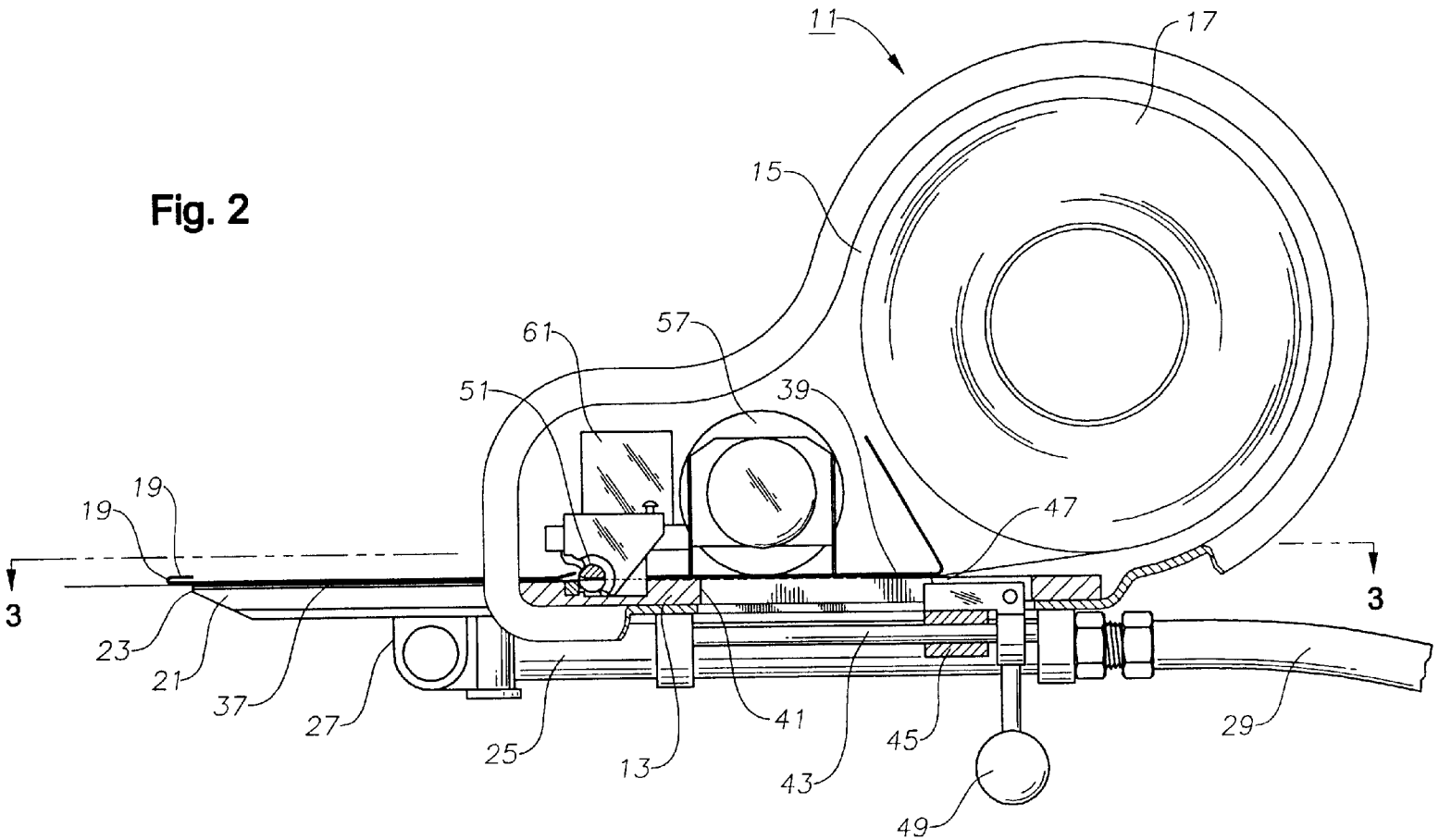
FIG. 2 is a sectional view of the dispenser of FIG. 1 as seen from the opposite side.

Referring to FIG. 2, dispenser 11 has a frame 13 that is preferably a rectangular plate. Frame 13 may be of any suitable material, such as a machinable plastic or metal. A housing 15, preferably of a plastic material, is mounted to frame 13. Housing 15 has a cylindrical portion having a compartment therein for holding a roll of tape 17. One side of housing 15 is hinged so as to be opened to access the roll of tape 17.

Figure 3:
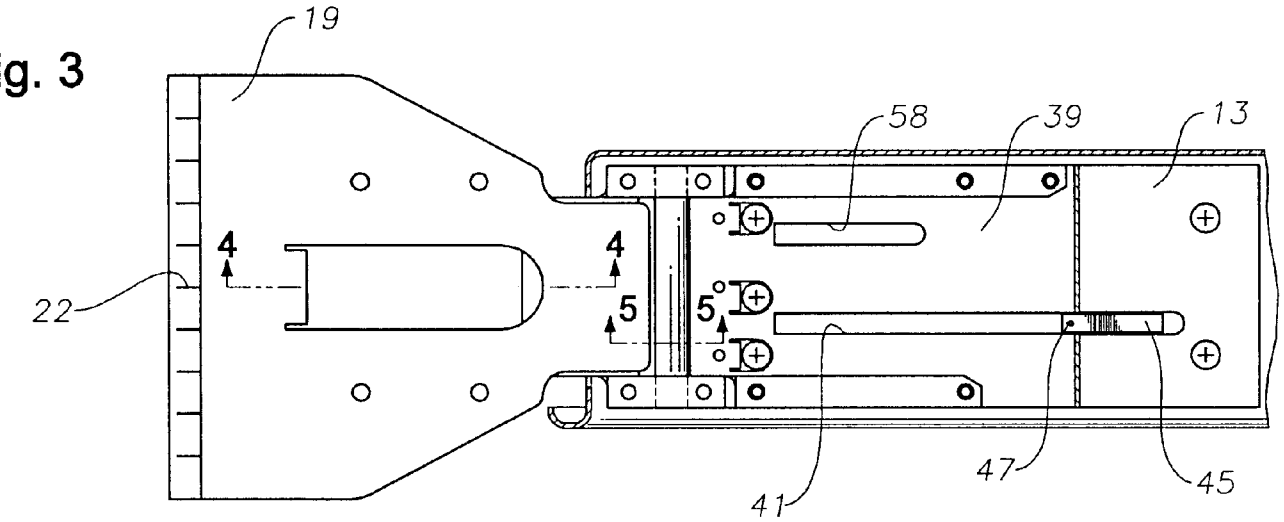
FIG. 3 is a sectional view of the dispenser of FIG. 1, taken along line 3—3 of FIG. 2.

A blade 19 is located at the forward end of frame 13 and housing 15. In this embodiment, blade 19 is straight and flat and can be readily removed for cleaning. Blade 19 has a rounded or blunt forward edge 20, which is formed at a radius. The radius on edge 20 reduces the chance for edge 20 to inadvertently cut the tape when reaching a comer. In this embodiment, blade 19 is of metal, and edge 20 is formed by bending a portion of blade over in a doubled back fashion. Blade 19 may also be of a plastic material. As shown in FIG. 3, a plurality of slits 22 are formed in blade 19 near edge 20 to increase flexibility.

Figure 4:
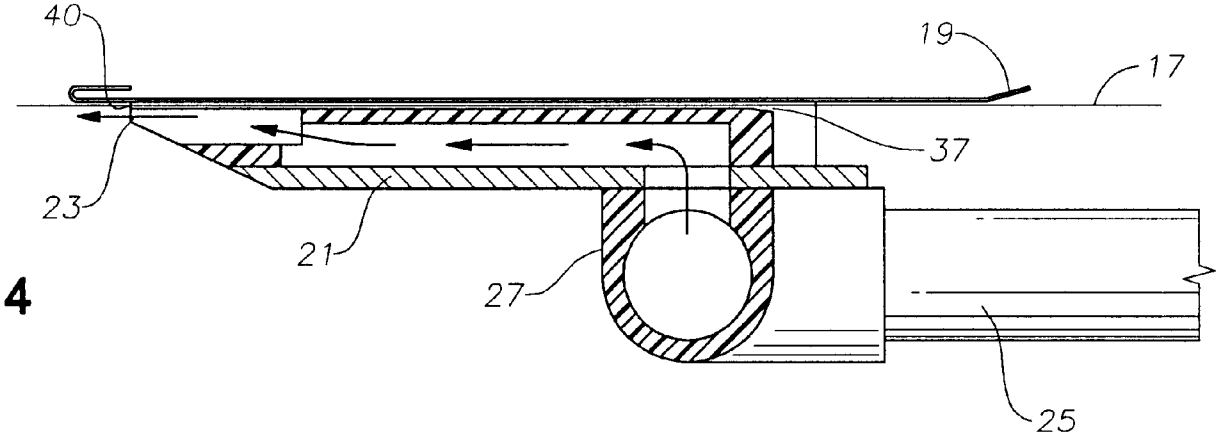
FIG. 4 is a sectional view of the dispenser of FIG. 1, taken along the line 4–4 of FIG. 3.

Referring to FIG. 4, a compound channel 21 is located below blade 19. Compound channel 21 is secured to a forward portion of frame 13 (FIG. 3), and may be considered a part of frame 13. Blade 19 overlies and is secured to compound channel 21. Compound channel 21 has a passage with a rectangular outlet 23 located just slightly rearward of the forward edge 20 of blade 19. The inlet to compound channel 21 comprises a manifold 27. Manifold 27 fits slidingly and sealingly to the forward end of a supply tube 25. Supply tube 25 extends under and parallel to frame 13, terminating at the rearward end of frame 13, as shown in FIG. 2. A flexible hose 29 secures by threads to the rearward end of supply tube 25. As shown schematically in FIG. 1, hose 29 leads to a pressure source 31, preferably a positive displacement progressive cavity pump 31, for pumping wall board compound from a reservoir 33. One or more thumb screws 35 are used to secure the assembly comprising compound channel 21, blade 19, and manifold 27 to frame 13 and supply tube 25. Screws 35 enable blade 19 and the associated components to be readily removed for cleaning.

Referring again to FIGS. 2 and 4, a tape slot 37 has a rearward portion that is defined by a retainer plate 39 and the upper surface of frame 13. Retainer plate 39 is located a short distance above and parallel to the upper surface of frame 13. Blade 19 extends forward from retainer plate 39 over compound channel 21, with the space between being the forward portion of tape slot 37. Tape slot 37 has an outlet 40 that is also rectangular and located immediately above compound outlet 23.

A web of tape 17 extends through tape slot 37 under retainer plate 39 and blade 19. An advancing mechanism is used to advance tape 17 manually until it protrudes from outlet 40. The advancing mechanism includes a slot 41 that is formed in frame 13, as shown in FIGS. 2 and 4. A slide bar 43 is mounted below and parallel to slot 41. A feeder mechanism 45 slides along the length of slide bar 43. Feeder mechanism 45 includes a prong 47 that extends upward through slot 41 to engage tape 17. A handle 49 extends from feeder mechanism 45. Moving handle 49 forward causes tape 17 to advance forward past the edge of blade 19.

Figure 5:
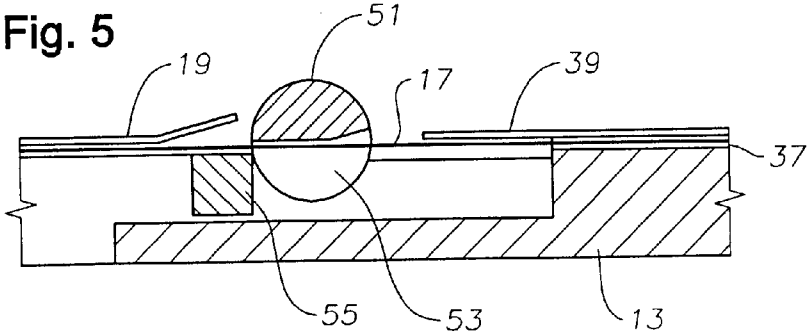
FIG. 5 is a partial sectional view of the dispenser of FIG. 1, taken along the line 5—5 of FIG. 3.

Referring to FIGS. 2 and 5, a cutter bar 51 is located near the forward end of frame 13 for cutting tape 17 when reaching the end of a stroke. Cutter bar 51 has a recessed portion 53, as shown in FIG. 5, that encompasses slightly more than half of the cylindrical cutter bar 51. Recess 53 has a sharp edge that sweeps past a stationary edge bar 55 to shear tape 17 while cutter bar 53 is rotated.

Referring again to FIG. 2, a tape movement sensor 57 is mounted in housing 15 on plate 39. Tape movement sensor 57 includes a wheel that extends through a slot 58 in plate 39 for engaging tape 17. Tape movement sensor 57 has a counter incorporated within it that will provide a signal proportional to the rate of rotation of the wheel of sensor 57. The signal, preferably a series of digital pulses, is communicated via a wire 60 (FIG. 1) to a control circuit 59. While in an automatic mode, control circuit 59 controls the speed of rotation of pump 31 so as to vary the flow rate depending upon the speed at which the tape is being dispensed. In one embodiment, control circuit 59 is a conventional circuit that provides a voltage output to the motor controller of the DC motor of pump 31 that is proportional to the pulse rate from sensor 57. Preferably, the output from control circuit 59 is linear, except at start up, when a booster portion of circuit 59 will provide a short duration of higher voltage so as to cause pump 31 to start at a higher rate than the linear relationship. The booster portion of circuit 59 serves to pressurize the hose so that control circuit 59 will operate in a linear relationship with the movement of blade 19. The booster circuit portion eliminates any process lag created by the lack of line pressure at the beginning of the process. Control circuit 59 could also be a programmable microprocessor.

Referring to FIGS. 2 and 6–8, an electrical switch assembly 61 is mounted in housing 15 adjacent cutter bar 51. Switch assembly 61 is also connected to wire 60 (FIG. 1) and control circuit 59. Electrical switch assembly 61 is employed both for automatic and manual operations of pump 31. Regardless of the mode, switch assembly 61 will turn pump 31 on and off, but it does not control the speed of pump 31. The speed of pump 31 during manual operation is handled by adjusting a separate speed control knob (not shown).

Figure 1:
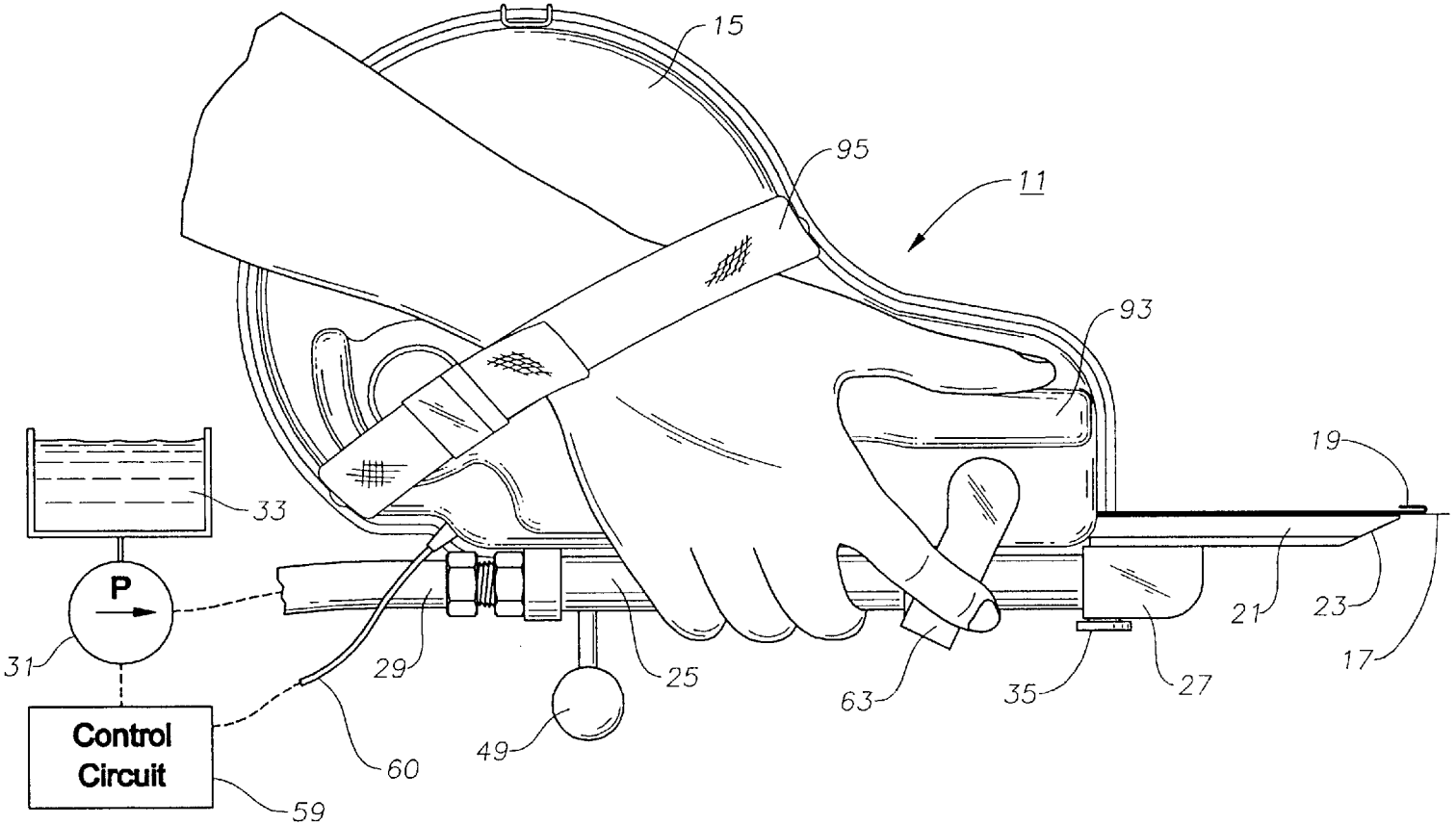
FIG. 1 is a side elevational view of a tape and compound dispenser constructed in accordance with the invention.

As shown in FIG. 1, a trigger 63 is used to actuate electrical switch assembly 61 (FIG. 2). Trigger 63 also rotates cutter bar 51 (FIG. 2) for severing tape 17. Trigger 63 has an off position which signals control circuit 59 to turn off pump 31. Trigger 63 has an on position that signals pump 31 to supply compound. Trigger 63 also has a cutting position that severs tape 17 and simultaneously turns off pump 31.

Figure 7:
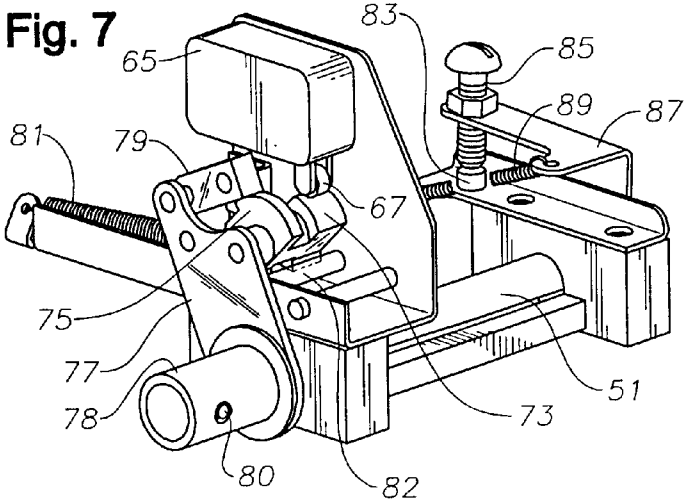
FIG. 7 is a view of the actuator and switch of FIG. 6, shown in an on position.
Figure 8:
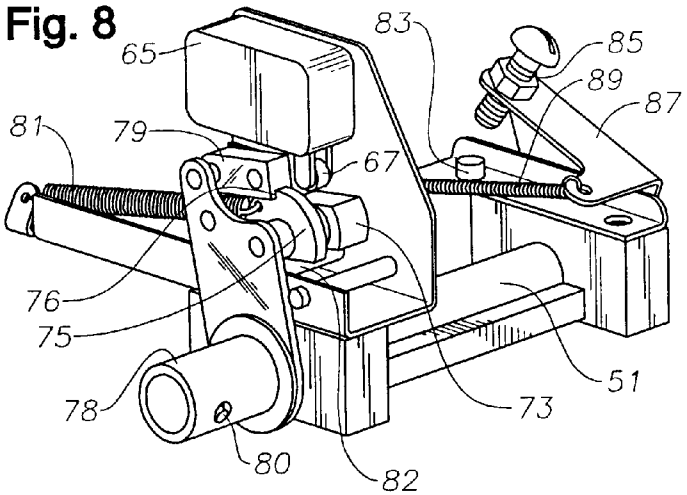
FIG. 8 is a perspective view of the actuator and switch of FIG. 6, shown in a severing position.
Figure 6:
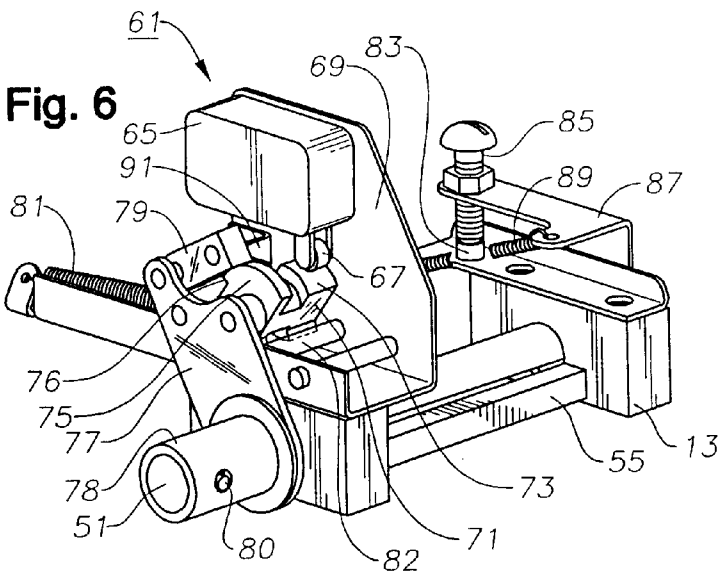
FIG. 6 is a perspective view of an electrical switch and actuator for controlling cutting of the tape and turning on and off a pump for delivering compound, the actuator and switch being shown in an off position in FIG. 6.
Figure 11:
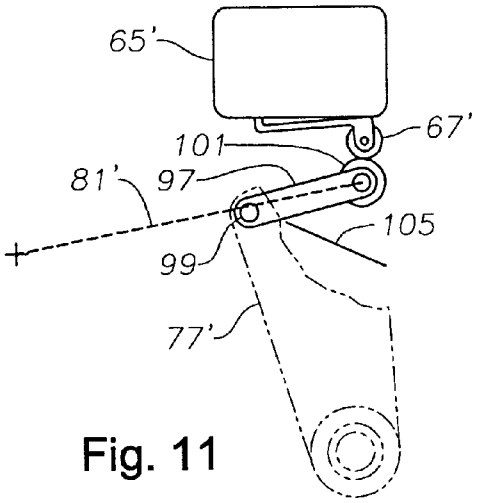
FIG. 11 is a schematic view of the actuator and switch of FIG. 9, shown in an on position.
Figure 10:
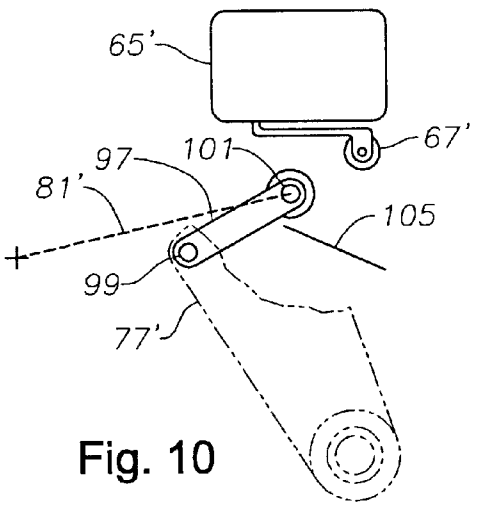
FIG. 10 is a schematic view of the actuator and switch of FIG. 9, shown in an off position.

Referring now to FIGS. 6–8, electrical switch assembly 61 includes an electrical switch 65 that has a switch roller 67. When switch roller 67 moves upward toward switch 65, switch 65 turns on pump 31 (FIG. 1). In the position shown in FIGS. 6 and 8, switch roller 67 is in a lower position, turning off pump 31. In the position of FIG. 7, switch roller 67 is in an upper position, turning on pump 31. Switch roller 67 could be eliminated and a sliding contact used, if desired.

Electrical switch 65 is mounted to a stationary bracket 69, which in turn is mounted to a portion of frame 13. A cam 71 is employed to move switch roller 67 between the upper and lower positions. Cam 71 has an inner lobe 73 that will engage cam roller 67 as cam 71 is moved along an arcuate path about the axis of cutter bar 51. In the position of FIG. 6, cam lobe 73 is spaced from or barely touching switch roller 67, causing switch roller 67 to place switch 65 in the off position. Inner lobe 73 has a curved portion that engages switch roller 67 as cam 71 is rotated about the axis of cutter bar 51 to push roller 67 upward, turning switch 65 on. If the user continues to rotate cam 71 about the axis of cutter bar 51, cam 71 rotates about its own axis, positioning a flat portion on cam lobe 73 under but not touching switch roller 67. As shown in FIG. 8, the flat portion allows switch roller 67 to move back to the lower position, shutting off pump 31 (FIG. 1).

Cam 71 also has an outer lobe 75 that is integrally formed with inner lobe 73. Outer lobe 75 has a curved cam surface that terminates in a notch 76. A lever 77 is rigidly mounted to a hub 78. Trigger 63 (FIG. 1) is rigidly mounted to hub 78, which slidingly receives one end of cutter bar 51. Hub 78 will rotate a selected rotational distance relative cutter bar 51, during which time a pin 80 in hub 78 engages a slot (not shown) formed in cutter bar 51. Once pin 80 reaches the end of the slot in cutter bar 51, continued rotation of trigger 63 (FIG. 1) and hub 78 causes cutter bar 51 to rotate in unison with hub 78 and lever 77.

Cam 71 is mounted to lever 77 via a pin that allows rotation of cam 71 relative to lever 77. Cam 71 is not mounted to stationary bracket 69, thus is free to move with lever 77 in an arcuate path about the axis of cutter bar 51. A pawl 79 is pivotally mounted to an upper end of lever 77. Pawl 79 has a spring (not shown) that urges it downward in a clockwise direction against outer lobe 75. Pawl 79 will engage the curved surface of outer lobe 75 while in the positions of FIG. 6 and 7, then as cam lobe 75 rotates relative to lever 77, pawl 79 will engage notch 76, as shown in FIG. 8. A coil spring 81 is secured to cam 71 for urging it to rotate in a counterclockwise direction.

Cam 71 has a lower surface with a shoulder configured to contact a trip bar 82 at a selected point after lever 77 begins to rotate clockwise due to movement of trigger 63 (FIG. 1). When cam 71 contacts trip bar 82, cam 71 will rotate clockwise relative to lever 77. Note in FIG. 7, cam 71 has rotated clockwise relative to lever 77 a certain distance, and in FIG. 8, rotated even a greater distance. As cam 71 rotates, its notch 76 will become aligned with the end of pawl 79, allowing pawl 79 to slip into engagement with notch 76 as shown in FIG. 8. This engagement causes cam 71 and lever 77 to remain in that position until trigger 63 (FIG. 1) is moved the opposite direction by the operator.

A magnet 83 is located on a part of frame 13 on the opposite side of cutter bar 51. A screw 85 of ferrous metal is positioned to engage magnet 83 while cutter bar 51 is in an open position, such is shown in FIGS. 2 and 5. Screw 85 is mounted to a bracket 87 that is rigidly secured to cutter bar 51 for rotation in unison. The magnetic attraction between magnet 83 and screw 85 serves as a detent to resist rotation of cutter bar 51 until sufficient force is applied by the operator rotating trigger 63 (FIG. 1) with his finger. This detent provides a positive indication to the operator that he has reached the point at which cutter bar 53 is beginning to rotate. If the operator does not intend to sever the tape, he should not pull trigger 63 past the detent indication. A coil spring 89 extends between bracket 87 and a portion of frame 13 to urge bracket 87 and cutter bar 51 into the open position. Portions of coil spring 89 are removed in FIGS. 6 and 7 for clarity.

Switch assembly 65 also includes a guide or cam plate 91 that is stationarily mounted to bracket 69 and engages pawl 79. Cam plate 91 causes pawl 79 to move upward when lever 77 is being rotated counterclockwise from the severing position of FIG. 8 . The upward movement of pawl 79 removes pawl 79 from its engagement with notch 76, enabling spring 81 to pull cam 71 back to the position shown in FIG. 6. This occurs only after cam lobe 73 has been rotated counterclockwise past switch roller 67. Cam lobe 73 remains in the position of FIG. 8 while lever 77 is being rotated back counterclockwise until it is past switch roller 67. This prevents cam lobe 73 from turning switch 65 on while moving from the cutting position of FIG. 8 back to the off position of FIG. 6.

Referring again to FIG. 1, housing 15 has a handle or grip 93 located on one side. Grip 93 protrudes from the side of housing 15 and is ergonomically configured to be gripped by a user's hand. An upper portion of grip 93 is positioned for placement of a thumb. Three fingers would typically be located under supply tube 25, with the index finger engaging control trigger 63. An adjustable and flexible strap 95 extends across housing 15 from a lower edge to an upper edge on the same side as the one that contains grip 93. Strap 95 forms a loop for the user to place his hand through while reaching for grip 93. Strap 95 fits across the back of the hand and the wrist for assisting in holding dispenser 11 in one hand. This frees the other hand of the user for other needs.

In operation the user will connect hose 29 to pump 31 and wire 60 to control circuit 59 as shown in FIG. 1. The user inserts his hand through strap 95 and grips supply tube 25 and grip 93. The user advances tape 17 (FIG. 2) forward so that it protrudes the forward edge of blade 19. This is done by grasping handle 49 and pushing it forward along slide bar 43. Prong 47 will engage tape 17, pull it from the roll and push it forward.

The user typically begins at an upper portion of a joint between wall boards to be taped. Tape 17 is placed against the wall under blade 19. The forward edge of blade 19 will be placed against the wall, and the operator will begin moving blade 19 downward while maintaining pressure of blade 19 against the wall. The friction of tape 17 against the wall due to the pressure of blade 19 causes the tape to feed out of housing 15. If the control circuit 59 (FIG. 1) is in an automatic mode, compound will begin flowing automatically through hose 29, supply tube 25 and compound channel 21 onto the wall surface and on the lower side of tape 17. This occurs because as tape 17 feeds from the roll, tape movement sensor 57 senses the movement and the rate of speed and provides a signal to control circuit 59 (FIG. 1). Control circuit 59 provides an initial full speed voltage output to pump 31, then after a short duration, controls the speed of pump 31 in proportion to the rate of which the user is moving dispenser 11 downward. If in the manual mode, the speed of pump 31 is controlled manually by a control knob on dispenser 11.

Pulling trigger 63 to the on position allows pump 31 to operate. The rotation of lever 77 causes cam 71 to swing in an arc about the axis of cutter bar 51. Inner cam lobe 73 will contact switch roller 67 and push it upward, turning switch 65 on, as shown in FIG. 7. The user will take care not to rotate trigger 63 past the detent indication caused by the attraction of screw 85 with magnet 83. FIG. 7 shows screw 85 just beginning to lift from magnet 83. While compound is being dispensed and pump 31 operating, the unit will be in the position of FIG. 7 or a position that is between FIG. 6 and FIG. 7. Switch roller 67 will be in the upper position. Cutter bar 51 will still be in the open position because of the slippage allowed through pin 80 and its slot on cam bar 51. Tape 17 will feed from housing 15 due to friction of the tape being pressed against the wall by blade 19.

This process continues until the user reaches the bottom of the wall board. At that time, the user will cut tape 17 and stop the flow of compound from pump 31. While in the automatic mode, merely stopping the movement of blade 19 causes pump 31 to automatically stop because tape sensor 57 will not sense any signals once tape 17 stops feeding. In both the automatic and manual modes, severing tape 17 is handled by moving trigger 63 clockwise until it stops.

Clockwise movement of trigger 63 (FIG. 1) from the on position of FIG. 7 to the sever position of FIG. 8 causes lever 77 to rotate farther. Pin 80 will reach the end of its slot in cutter bar 51, causing cutter bar 51 to rotate to a cutting position in which its sharp edge will move past stationary edge 55 (FIG. 5), severing tape 17. Simultaneously during this movement, trip bar 82 will cause cam 71 to rotate clockwise relative to lever 77 to the position shown in FIG. 8. In this position, the flat side of inner cam 73 locates under switch roller 67, allowing it to move downward to an off position, turning off pump 31. Also, at the same time, pawl 79 will drop in the recess behind notch 76 to hold cam 71 in this position shown in FIG. 8. Although spring 81 urges cam 71 to rotate counterclockwise relative to lever 71, pawl 79 prevents its rotation. clockwise, but pawl 79 will also hold it in the position of FIG. 8.

The user moves it from the severing position by releasing pressure on trigger 63, allowing spring 81 to rotate trigger 63 counterclockwise. This causes pawl 79 to move rearward and upward due to its engagement with guide 91 (FIG. 6). This frees pawl from notch 76, allowing cam 71 to rotate counterclockwise back to the initial off position of FIG. 6. This rotation occurs after cam lobe 73 has moved past switch roller 67 as lever 71 rotates counterclockwise. At the same time, bracket 87 and cutter bar 51 will rotate counterclockwise back to the position of FIG. 6. When moving from the cutting position back to the off position, lobe 73 will not engage switch roller 67 to turn switch 65 on. To start again, the operator manually advances the tape to the forward edge 20 of blade 19 and begins the process again.

FIGS. 9–12 show an alternate embodiment for the actuator mechanism illustrated in FIGS. 6–8. Components that are the same will be indicated by a prime symbol. Lever 77' has its axis of rotation spaced below switch 65' in the same manner as in the first embodiment. A link 97 is pivotally mounted to lever 77' by a pivot pin 99. A cam roller 101 is rotatably mounted to a pin 100 that extends from link 97 on the end of link 97 opposite pin 99. Cam roller 101 is positioned to engage switch roller 67' to push it upward, turning switch 65' on, when lever 77' is rotated from the off position of FIG. 10 to the on position shown in FIG. 11. Spring 81' extends from a stationary point to pin 100. Spring 81' urges lever 77' in a counterclockwise direction.

Figure 9:
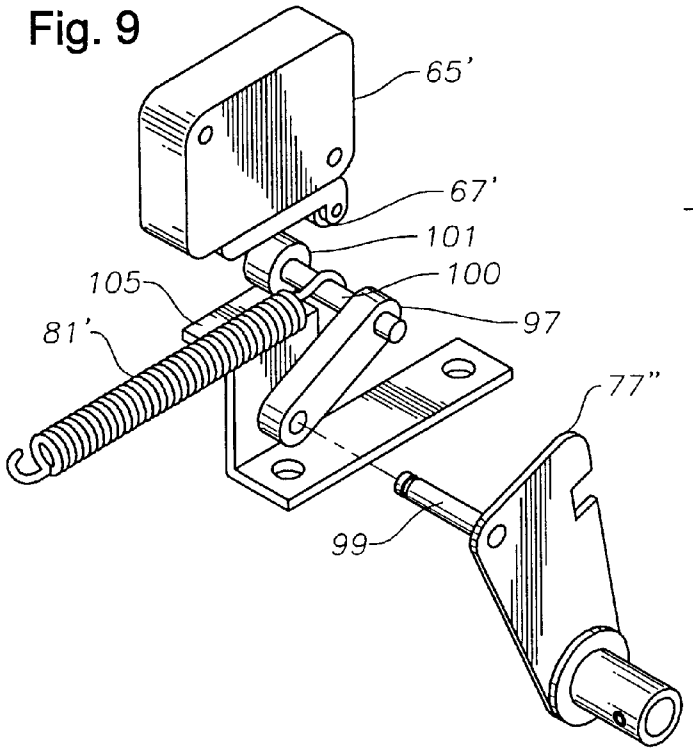
FIG. 9 is an exploded perspective view of an alternate embodiment of an actuator and switch.

Spring 81' also serves as an over center device for link 97. While in the off position of FIG. 10, spring 81' is located above pin 99, thus urging link 97 to rotate counterclockwise relative to lever 77'. Cam roller 101 contacts a portion of switch 65' behind switch roller 67', thus does not actuate switch 65' while in the off position. Pulling trigger 63 (FIG. 1) to an on position causes lever 77' to rotate about its axis in the clockwise direction. Link 97 moves with lever 77' and will contact switch roller 67', turning switch on as shown in FIG. 9. The magnetic detent 83, 85 (FIGS. 6–8) will still be in engagement, but further pulling of trigger 63 will be resisted by the magnetic force, indicating to the operator not to apply more force to trigger 63 unless it is desired to cut the tape. Spring 81' will be slightly above pin 99 in this position, thus still urging link 97 to rotate counterclockwise relative to lever 71'.

Figure 12:
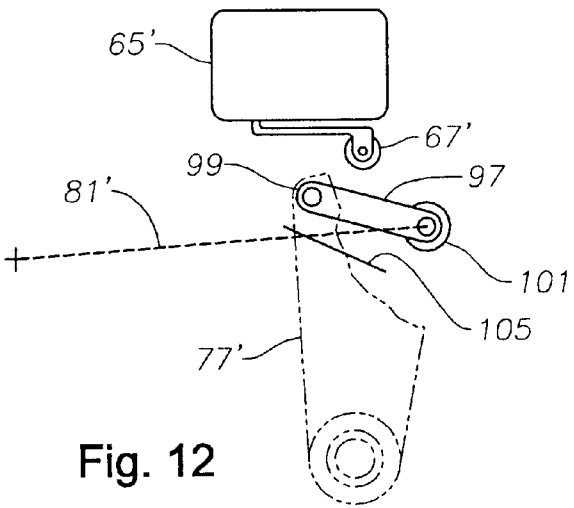
FIG. 12 is a schematic view of the actuator and switch of FIG. 9, shown in a tape cutting position.

To cut the paper, the operator continues rotation of trigger 63 (FIG. 1), causing cutter bar 51 (FIG. 5) to cut the tape. The continued rotation causes pin 99 to move above spring 81, as shown in FIG. 12. Spring 81 in this over center position now urges link 97 to rotate clockwise relative to lever 77'. This rotation positions cam roller 101 below switch roller 67', turning switch 65' off.

After cutting the tape, the operator releases trigger 63 (FIG. 1), which causes spring 81 to rotate lever 77' back in a counterclockwise direction. While rotating counterclockwise, cam roller 101 will be lower than switch roller 67' because spring 81 will continues to urge link 97 to rotate clockwise relative to lever 77'. Consequently, cam roller 101 will not actuate switch roller 67 while lever 71 is rotating counterclockwise back from the cutting position of FIG. 12. Spring 81 is still in the over center position relative to pin 99 during the initial counterclockwise rotation of lever 77' from the cutting position. After passing under switch roller 67, cam roller 101 will engage cam plate 105. Cam plate 105 inclines upward, causing link 97 to rotate counterclockwise about pin 99 relative to lever 77' past the over center position. This brings spring 81' back from the over center position of FIG. 12 to the position of FIG. 10. Spring 81' now again urges link 97 to rotate counterclockwise relative to lever 77'.

The invention has significant advantages. The dispenser dispenses tape and compound with a device that can be readily carried in one hand, freeing the other hand for other needs. The strap allows the user to comfortably grip the unit with one hand. The separate compound and tape slots dispense compound on the underside of the tape at the appropriate point. Separating the tape and compound until reaching the edge of the blade avoids contacting the tape with compound in the interior of the housing, which would result in additional cleaning A single lever will simultaneously stop flow from the pump and sever the tape, avoiding extruding excess compound at the end of the stroke.

While the invention has been shown only in one of its forms, it should be apparent to those skilled in the art but it is not so limited that it is susceptible to various changes without departing it from the scope of invention. For example, although the lever controls flow of compound from the pump by turning the pump on and off, the lever could optionally operate a valve to control the flow of compound rather than turning the pump on and off.

We claim:

1. A tape and wallboard compound dispenser, comprising:

a frame;

a blade mounted to a forward end of the frame;

the frame having a tape channel that has a rectangular outlet below and rearward of the blade for receiving a web of tape to be applied to a wall surface; and the frame having a compound channel that is separated from the tape channel, the compound channel having an inlet for receiving compound delivered through a hose to the compound channel, the compound channel having a rectangular outlet below the outlet of the tape channel and rearward of the blade for dispensing compound onto the wall surface as the tape is being applied, the blade serving to wipe excess compound from the wall surface.

2. The dispenser according to claim 1, further comprising a flexible strap carried by the frame, defining a loop for insertion of a limb of a user to carry the dispenser.

3. The dispenser according to claim 1, further comprising:

a tape roll housing mounted to the frame, having a storage compartment therein for holding a roll of tape, the storage compartment being in communication with an inlet of the tape channel.

4. The dispenser according to claim 1, further comprising:

a tape roll housing mounted to the frame, having a storage compartment therein for holding a roll of tape, the storage compartment being in communication with an inlet of the tape channel; and a flexible strap mounted to the housing, defining a loop for insertion of a hand of a user, the loop adapted to extend across a wrist of the user to assist in holding the dispenser.

5. The dispenser according to claim 1, further comprising:

a longitudinal slot formed in a lower side of the tape channel; and a manual feed member mounted below the tape channel, the feed member having a protrusion that extends into the slot for manually advancing the tape by moving the feed member in a forward direction.

6. The dispenser according to claim 1, further comprising:

an electrical actuator switch carried by the frame for controlling the delivery of compound from the pump;

a cutting mechanism for severing the tape; and a manually actuable lever operatively connected with the switch and the cutting mechanism, the lever having an off position for shutting off flow of compound to the compound channel, an on position for allowing flow of compound to the compound channel, and a cutting position for actuating the cutting mechanism to cut the tape and simultaneously shutting off flow of compound to the compound channel.

7. The dispenser according to claim 1, further comprising:

a cutter bar mounted transversely across the tape channel, the cutter bar being rotatable for cutting the tape; and a lever operatively connected with the cutter bar for rotating the cutter bar to cut the tape.

8. An apparatus for applying tape and dispensing wallboard compound to a wall surface, comprising:

a housing having a tape compartment therein for receiving a roll of tape;

a tape channel having an inlet in the tape compartment and an outlet for dispensing the tape;

a compound channel having an inlet for receiving compound and an outlet adjacent the outlet of the tape channel for dispensing compound onto the wall surface as the tape is being applied;

a pump connected to the inlet of the compound channel for delivering compound via a hose to the compound channel;

a grip protruding from one side of the housing for gripping by a user; and a flexible strap extending over the grip for engaging a wrist of a user while the user is gripping the grip to assist the user in holding the housing.

9. The apparatus according to claim 8, further comprising:

an electrical actuator switch carried by the housing for controlling flow of compound from the pump;

a cutting mechanism carried by the housing for severing the tape; and a manually actuable lever operatively connected with the switch and the cutting mechanism, the lever having an off position that prevents flow of compound from the pump, an on position that allows flow of compound from the pump, and a cutting position that actuates the cutting mechanism to cut the tape and simultaneously prevents flow of compound from the pump.

10. The apparatus according to claim 8, further comprising:

a cutter bar mounted transversely across the tape channel, the cutter bar being rotatable for cutting the tape; and a lever operatively connected with the cutter bar for rotating the cutter bar to cut the tape.

11. The apparatus according to claim 8, further comprising:

an electrical actuator switch carried by the housing for controlling flow of compound from the pump;

a cutter bar mounted transversely across the tape channel, the cutter bar being rotatable for cutting the tape; and a manually actuable lever operatively connected with the switch and the cutter bar, the lever having an off position that prevents flow of compound from the pump, an on position that allows flow of compound from the pump, and a cutting position that rotates the cutter bar to cut the tape and simultaneously prevents flow of compound from the pump.

12. The apparatus according to claim 8, wherein the tape channel and the compound channel are separated from each other, and wherein each of the outlets is rectangular and spaced rearward of a forward edge of the blade.

13. The apparatus according to claim 8, further comprising a blade mounted to a forward portion of the housing, the blade having an edge spaced forward of the outlets of the tape channel and the compound channel for wiping excess compound on the wall surface.

14. The apparatus according to claim 8, further comprising:

a longitudinal slot formed in a lower side of the tape channel;

a slide member mounted below and parallel with the slot; and a manual feed member mounted slidably to the slide member, the feed member having a protrusion that extends into the slot for manually advancing the tape by moving the feed member in a forward direction.

15. An apparatus for applying tape and dispensing wallboard compound to a wall surface, comprising:

a frame;

the frame having a tape channel for receiving a web of tape to be applied to a wall surface;

the frame having a compound channel that has an inlet for receiving compound and dispensing compound onto the wall surface as the tape is being applied;

a pump connected to the inlet of the compound channel for delivering compound via a hose to the compound channel;

an electrical actuator switch carried by the frame for controlling flow of compound from the pump;

a cutting mechanism carried by the frame for severing the tape; and a manually actuable lever operatively connected with the switch and the cutting mechanism, the lever having an off position that prevents flow of compound from the pump, an on position that allows flow of compound from the pump, and a cutting position that actuates the cutting mechanism to cut the tape and simultaneously prevents flow of compound from the pump.

16. The apparatus according to claim 15, wherein the cutting mechanism comprises a cutter bar mounted transversely across the tape channel, the cutting bar being rotatable and having a sharp edge.

17. The apparatus according to claim 15, wherein the actuator switch comprises:

a cam member mounted to the lever that engages and actuates the switch as the lever is rotated to on position, the cam member being rotatable relative to the lever to disengage from the switch when the lever is rotated past the on position to the cutting position.

18. The apparatus according to claim 15, further comprising:

a longitudinal slot formed in a lower side of the tape channel;

a slide member mounted below and parallel with the slot; and a manual feed member mounted slidably to the slide member, the feed member having a protrusion that extends into the slot for manually advancing the tape by moving the feed member in a forward direction.

19. The apparatus according to claim 15, further comprising a blade mounted to a forward portion of the housing, the blade having an edge spaced forward of the outlets of the tape channel and the compound channel for wiping excess compound on the wall surface.

20. A method for applying tape and dispensing wallboard compound to a wall surface, comprising:

providing a dispenser having frame with a tape channel and a compound channel, an electrical actuator switch, a cutting mechanism, and a control level for the switch and the cutting mechanism;

placing the lever in an off position, inserting tape from a tape roll into the tape channel, and connecting the pump to the compound channel, the lever while in the off position causing the switch to prevent flow of compound from the pump; then placing the lever in an on position, causing the switch to allow flow of compound from the pump to the compound channel, and simultaneously moving the dispenser along the wall surface to dispense tape from the tape roll; then placing the lever in a cutting position, which simultaneously causes the switch to prevent further flow of compound from the pump and actuates the cutting mechanism to cut the tape.

21. The method according to claim 20, wherein the switch turns off the pump while the lever is in the off position and in the cutting position, and turns on the pump while the lever is in the on position.

* * * * *